US005456414A

United States Patent [19]

Burns et al.

[11] Patent Number: 5,456,414

[45] Date of Patent: Oct. 10, 1995

[54] SUCTION FEED NOZZLE ASSEMBLY FOR HVLP SPRAY GUN

[75] Inventors: Marvin D. Burns, Millbury; Raymond E. Reitz, Perrysburg, both of Ohio

[73] Assignee: Ransburg Corporation, Indianapolis, Ind.

[21] Appl. No.: 275,532

[22] Filed: Jul. 15, 1994

Related U.S. Application Data

[63] Continuation-in-part of Ser. No. 144,279, Oct. 28, 1993, abandoned.

[51] Int. Cl.[6] ..... B05B 7/08

[52] U.S. Cl. ..... 239/296; 239/407; 239/DIG. 14

[58] Field of Search ..... 239/290, 296, 239/DIG. 14, 413–415, 416.4, 417.3, 423, 424, 424.5, 433, 8, 601, 407

[56] References Cited

U.S. PATENT DOCUMENTS

| | | | |
|---|---|---|---|
| 2,511,626 | 6/1950 | Einbecker | 239/415 |
| 3,032,277 | 5/1962 | Petty | 239/414 X |
| 3,072,346 | 1/1963 | Wahlin et al. | 239/601 X |
| 4,343,433 | 8/1982 | Sickles | 239/414 X |
| 4,544,100 | 10/1985 | Simashkevich et al. | 239/407 |
| 4,767,057 | 8/1988 | Degli et al. | 239/296 |
| 4,993,633 | 2/1991 | Mellette | 239/414 X |
| 5,064,119 | 11/1991 | Mellette | 239/414 X |
| 5,074,466 | 12/1991 | Santiago | 239/8 |
| 5,078,322 | 1/1992 | Torntore | 239/414 X |
| 5,090,623 | 2/1992 | Burns et al. | 239/301 |
| 5,165,605 | 11/1992 | Morita et al. | 239/296 |
| 5,180,104 | 1/1993 | Mellette | 239/8 |
| 5,199,644 | 4/1993 | Haferkorn | 239/296 |
| 5,209,405 | 5/1993 | Robinson et al. | 239/296 |
| 5,249,746 | 10/1993 | Kaneko et al. | 239/296 |
| 5,344,078 | 9/1994 | Fritz et al. | 239/296 |

FOREIGN PATENT DOCUMENTS

| | | | |
|---|---|---|---|
| 456523 | 11/1991 | European Pat. Off. | 239/296 |
| 676600 | 7/1952 | United Kingdom | 239/296 |
| 2215239 | 9/1989 | United Kingdom | 239/296 |

*Primary Examiner*—Andres Kashnikow
*Assistant Examiner*—Lesley D. Morris
*Attorney, Agent, or Firm*—MacMillan, Sobanski & Todd

[57] ABSTRACT

For an HVLP paint spray gun, an improved suction feed nozzle assembly including a fluid tip and an air cap. The air cap directs an annular flow of atomization air around a fluid discharge orifice formed by a tubular portion on the fluid tip to aspirate fluid from the orifice and to atomize the fluid. The air cap also directs pattern shaping air at the atomized paint. According to one feature of the invention, the spacing of the pattern shaping air orifices from the fluid discharge orifice is made sufficiently great that undue turbulence is not induced in the atomization air in the aspiration zone to maximize the fluid flow rate. According to a second feature of the invention, the fluid orifice in the fluid tip has a straight cylindrical portion and an expanding conical section connecting the cylindrical section to an annular flat front face of the tubular portion of the fluid tip. The flat portion of the front face on the tubular portion is kept to a minimum to increase the particle distribution uniformity of the atomized paint. Preferably, a sharp corner if formed between the flat face and the sides of the cylindrical section to optimize fluid flow at low air pressures.

11 Claims, 2 Drawing Sheets

SUCTION FEED NOZZLE ASSEMBLY FOR HVLP SPRAY GUN

This is a Continuation-in-Part to application Ser. No. 08/144,279, filed Oct. 28, 1993 and now abandoned.

TECHNICAL FIELD

The invention relates to spray guns for atomizing liquid and more particularly to an improved nozzle assembly for a suction feed high volume low pressure (HVLP) air atomization paint spray gun.

BACKGROUND ART

One class of spray gun uses pressurized air for atomizing liquid such as paint and for shaping the envelope or pattern of the atomized liquid as it is discharged from a nozzle assembly on the gun. Air atomization spray guns broadly fall into two classes. One type of air atomization spray gun uses a low volume flow of high pressure air for atomization and pattern shaping. The air pressure typically may be on the order of from 40 psig (2.81 Kg/cm$^2$) to as high as 100 psig (7.03 Kg/cm$^2$), or more. The spray gun includes a nozzle assembly having a fluid tip and an air cap. The fluid tip has an orifice which discharges the fluid for atomization. The air cap forms an annular air discharge orifice which surrounds the fluid orifice and also has a pair of horns which discharge air from orifices for shaping the envelope of the atomized fluid into a flat, fan shaped pattern. The nozzle assembly receives the fluid and compressed air and discharges and atomizes the fluid. The fluid may be delivered to the nozzle assembly through pressure feed, gravity feed or suction feed. For many applications, the fluid is drawn through the nozzle assembly by suction produced by the flow of high pressure air. The air is discharged through an annulus which surrounds a fluid orifice, creating a suction at the orifice. The suction is sufficient to draw the fluid, such as paint, from a cup attached to the gun through supply passages in the gun to the orifice where it is discharged and atomized. For many applications, such as automotive refinishing, suction feed is preferred because of the ease of use and cleanup. The equipment is much easier to clean for color change, for example, than pressure feed equipment which requires a pressure pot and hoses connecting the pressure pot to the spray gun.

A second type of air atomization paint spray gun uses a relatively high volume flow of low pressure air for atomization and pattern shaping. The lower air pressure imparts a lower velocity to the atomized paint. The lower velocity droplets are less prone to be deflected from the surface being coated. Consequently, the transfer efficiency is increased and less paint may be dispersed into the environment. The pressure of the atomization and pattern shaping air used for HVLP spay guns is generally less than about 15 psig (1.05 Kg/cm$^2$) and often is kept to less than 10 psig (0.703 Kg/cm$^2$) to comply with government regulations. Some jurisdictions, for example, provide more lax air pollution control regulations if the air discharge pressure at the nozzle is no greater than 10 psig (0.703 Kg/cm$^2$). The low air pressure may be produced either through the use of a high volume low pressure air turbine or by using a conventional high pressure compressed air source and suitable means for lowering the air pressure and increasing the volume flow, such as calibrated pressure dropping orifices or a pressure regulator.

In the past, HVLP paint spray guns have generally used pressure feed for the paint and sometimes have used gravity feed. Because of the low atomization air pressure, suction feed has not been very successful. The low air pressure has produced insufficient suction to achieve an acceptable paint flow rate. For example, one previous attempt to suction feed paint to a spray gun having a standard nozzle assembly produced a paint flow rate of only 10 to 30 grams/minute. Another attempt with existing combinations of air caps and fluid tips only achieved a flow rate of 150 grams/minute. These flow rates are inadequate for production operations, such as commercial automobile refinishing. For commercial applications, a minimum acceptable flow rate is about 200 to 220 grams/minute and a higher flow rate is preferable.

In prior art HVLP paint spray guns, the pattern of the atomized paint has not always had an optimum particle distribution uniformity. It has been found that particle distribution non uniformity for pressure feed guns is generally better than for gravity and suction feed guns and that the particle distribution uniformity is worse with suction feed.

DISCLOSURE OF INVENTION

The invention is directed to a nozzle assembly for HVLP paint spray guns which is suitable for suction feed and provides higher paint flow rates than those achieved in the past and also provides a good uniformity to the pattern of the atomized paint or other fluid. By modifying the fluid tip and air cap configuration, flow rates of from 200 grams/minute to at least 300 grams/minute have been achieved. Further, improvements to the fluid tip portion of the nozzle assembly have improved particle distribution uniformity in the atomized paint.

To achieve suction feed in a spray gun, atomization air is discharged around a fluid orifice to create an aspiration zone which draws the paint from the orifice. The air flow then brakes up and atomizes the paint into fine droplets. The atomized paint and air form an expanding conical envelope. Immediately after the droplets are atomized, air is directed from orifices in horns on opposite sides of the flow pattern towards the conical envelope to shape the envelope into a flat fan shaped pattern. An HVLP spray gun uses a relative large volume flow of low pressure air for both atomization and pattern shaping. As a consequence of the low air pressure, the atomization air has a relatively low velocity. It has been found that the atomization air is influenced by the pattern shaping air because of its low velocity more than in a spray gun which uses high pressure air for atomization. The pattern shaping air can create turbulence in the aspiration zone adjacent the fluid discharge orifice which reduces the suction drawing the fluid through the orifice. As a consequence, inadequate suction is created and the resulting paint flow rate is insufficient for commercial application. According to the invention, the pattern shaping air orifices are spaced further from the aspirating zone to reduce or eliminate the adverse influence on the paint flow rate. The greater spacing for the pattern shaping orifices in turn permits increasing their size for a greater pattern shaping air flow rate. The increased pattern shaping air flow produces a longer pattern.

For a nozzle assembly for a suction feed spray gun, as well as for nozzle assemblies for many gravity and pressure feed HVLP spray guns, the fluid tip has a tubular projection which extends coaxially into an atomization air orifice in the air cap. The fluid discharge orifice is in the tubular projection and opens at an annular face. For suction feed, the tubular projection must extend completely through the atomization air orifice. It has been found that the flat annular face on the tubular projection may adversely affect the paint distribution in the atomized paint envelope. It has been found that an improved paint distribution can be achieved by providing a short straight cylindrical section to the paint flow passage through the fluid tip to help achieve laminar flow and an outwardly opening conical section between the cylindrical section and the flat front face on the tubular projection. The conical section in the passage reduces the flat area on the front face. Optionally, a small chamfer also may be placed on the outside comer of the front end of the tubular projection to further reduce the size of the flat area. The chamfer protects the comer of the tubular projection from damage. However, it has been found that an improved paint flow rate can be achieved by providing a sharp comer on this outside edge. The flow rate improvement becomes more substantial as the pressure is decreased. This allows even lower pressures to be used which further enhances the benefits of the HVLP spray gun mentioned above.

Accordingly, it is an object of the invention to provide an improved nozzle assembly for HVLP spray guns which is suitable for suction feed.

Other objects and advantages of the invention will become apparent from the following detailed description of the invention and the accompanying drawings.

BEST MODE FOR CARRYING OUT THE INVENTION

Figure 1:
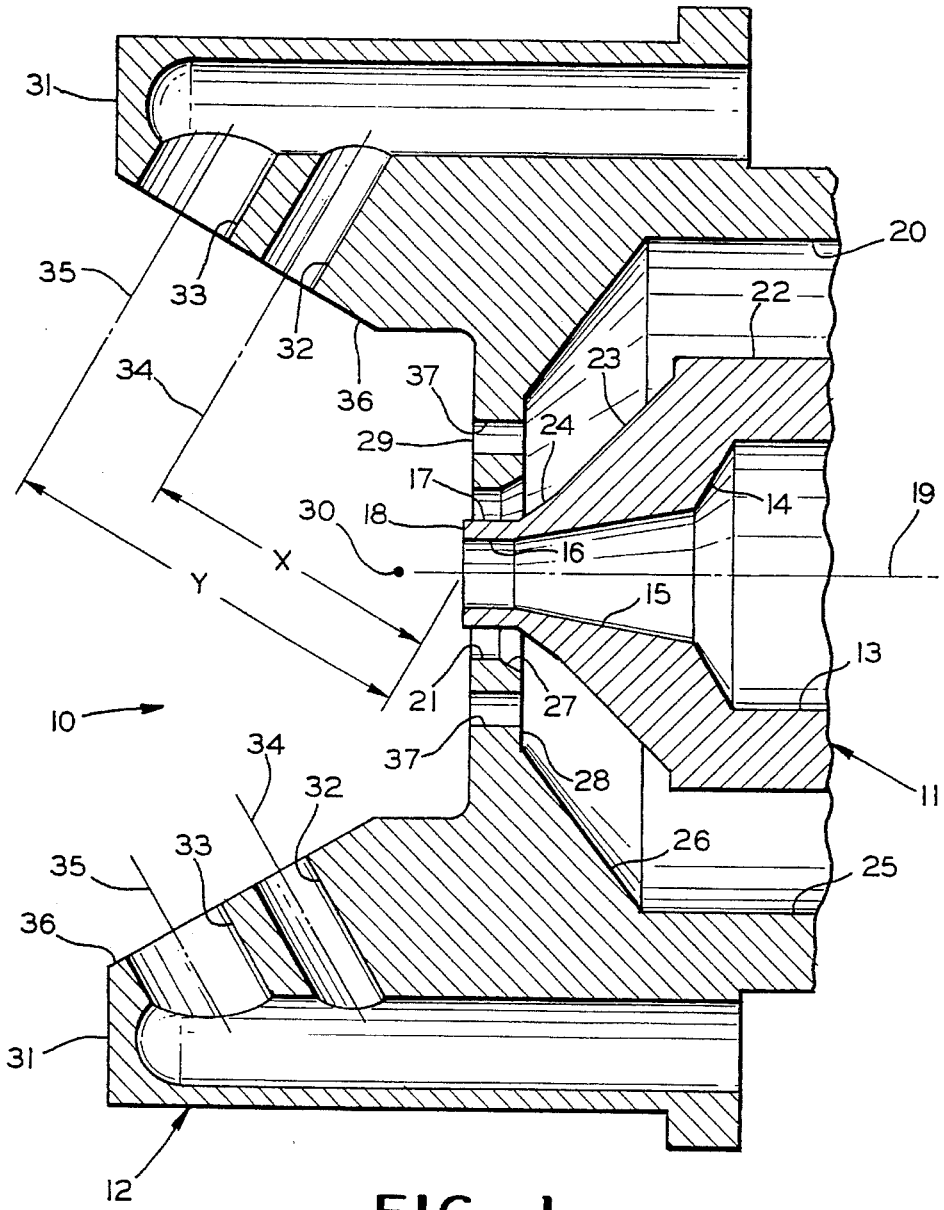
FIG. 1 is a an enlarged fragmentary cross sectional view through a nozzle assembly for a suction feed HVLP paint spray gun according to the invention.
Figure 2:
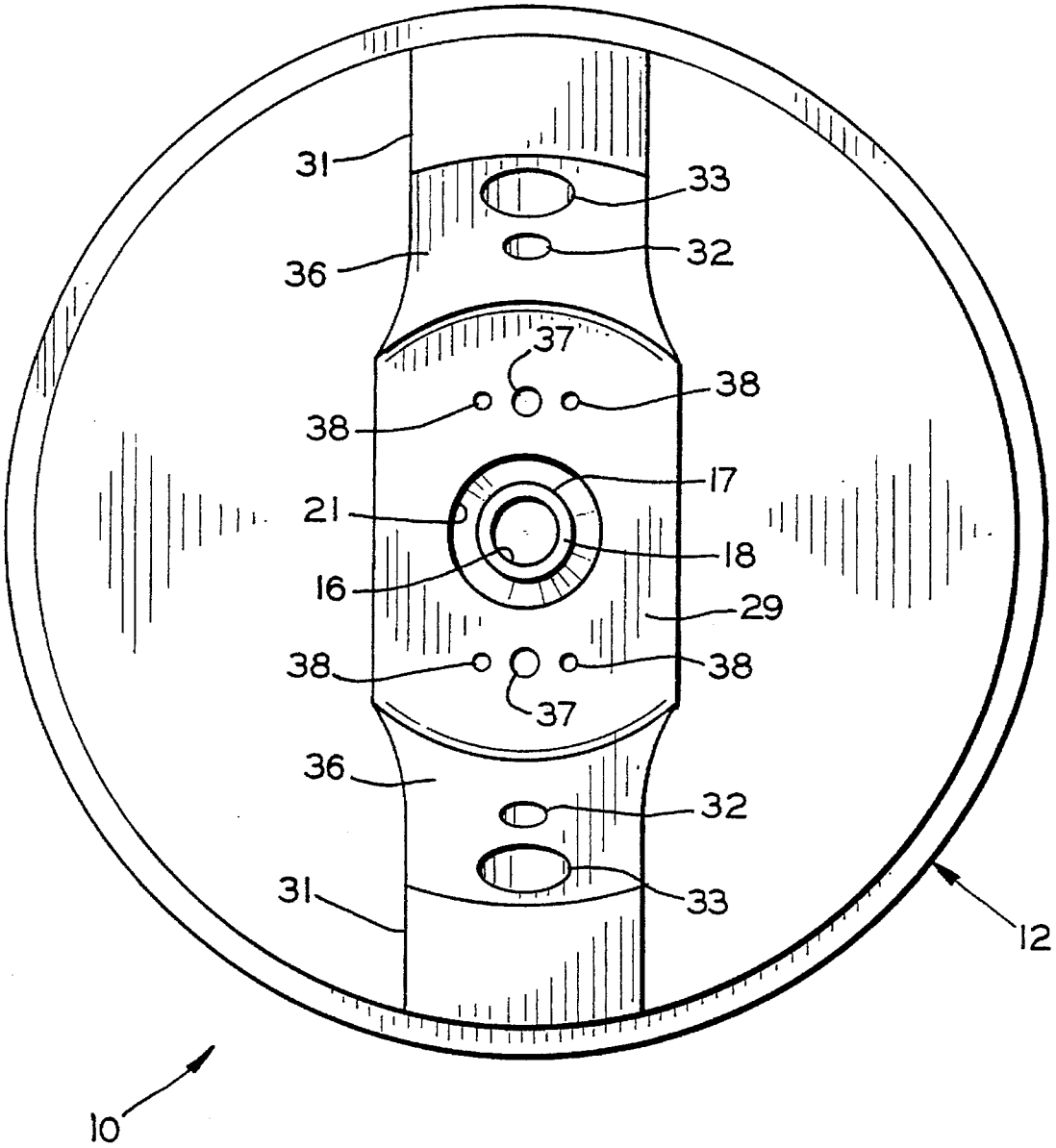
FIG. 2 is an enlarged front elevational view of the nozzle assembly of FIG. 1.

Referring now to FIGS. 1 and 2 of the drawings, a nozzle assembly 10 for an HVLP paint spray gun is illustrated according to the invention. The nozzle assembly 10 includes a fluid tip 11 and an air cap 12. The fluid tip 11 has a central chamber 13 which receives the paint or other fluid to be sprayed. At a front end 14 of the chamber 13, a conical seat 15 is located for engagement by a fluid valve needle (not shown), as is well known in the art. The seat 15 leads to a fluid discharge orifice 16 which extends through a tubular projection 17 on the fluid tip 11. The tubular projection 17 has a flat annular front face 18. The seat 15, the orifice 16, the tubular projection 17 and the front face 18 are all coaxial with an axis 19.

The air cap 12 also is positioned so that an internal air chamber 20 and an atomization air orifice 21 are coaxial with the axis 19. The exterior of the fluid tip 11 has a cylindrical rear surface 22. A conical surface 23 is located forward of the cylindrical surface 22 and a second, smaller conical surface 24 is located between the conical surface 23 and the tubular projection 17. In order to promote laminar flow in the atomization air, the air cap chamber 20 and orifice 21 have generally the same shape as the fluid tip surfaces. Thus, the chamber 20 has a cylindrical surface 25 spaced from the cylindrical fluid tip surface 22, a conical surface 26 spaced from the conical surface 23, a conical surface 27 spaced from the conical surface 24, and the cylindrical orifice 21 spaced from the tubular projection 17. A flat face 28 separates the air cap surfaces 26 and 27 to constrict the air flow passage towards the orifice 21.

The fluid tip projection 17 extends completely through the atomization air orifice 21. Preferably, the projection 17 is either flush with a front face 29 on the air cap 12 or projects up to 0.020 inch (0.0508 cm) from the front face 29 to improve suction. The optimum tip projection was found to be 0.015 inch (0.0381 cm). A high volume flow of low pressure air is discharged from the chamber 20 through the annular orifice 21 in an annular pattern which surrounds the fluid discharge orifice 16. This creates a reduced pressure or suction in an aspiration zone 30 immediately in front of the orifice 16. When sufficient suction is created in the aspiration zone 30, paint is drawn from the orifice 16 into the aspiration zone 30 where it is atomized and carried forward by the air flow.

As the paint is atomized and carried forward, its envelope has a diverging conical shape. It is generally desirable to impart a flat fan shape to the atomized paint envelope. This is achieved by directing one or more pairs of jets of air at diametrically opposite sides of the conical envelope. Two air horns 31 extend forward from the front face 29 of the air cap 12. The air horns 31 are spaced from and extend on opposite sides of the atomized paint envelope. First and second orifices 32 and 33 are located on each air horn 31. The first orifices 32 are located opposite each other and the second orifices 33 are located opposite each other. The orifices 32 have axes 34 which are inclined at equal and opposite angles to the axis 19 and the orifices 33 have axes 35 are inclined at equal and opposite angles to the axis 19. The axes 19, 34 and 35 are coplanar.

As indicated above, the envelope of the atomized paint diverges as it moves away from the fluid discharge orifice 16. A face 36 on each air horn 31 is angled to maintain a spacing between the atomized paint and the horns 31, even when the pattern shaping air is turned off. Since the atomized paint pattern is larger as the spacing from the orifice 16 increases, a larger volume of pattern shaping air can be used at a further spacing from the orifice 16. Consequently, the orifices 33 which are spaced further from the orifice 16 are larger than the orifices 32.

In order to help prevent paint from depositing on the air cap 12 and to enhance the atomized paint pattern, a pair of auxiliary orifices 37 are located in the air cap face 29. One of the orifices 37 is located between the atomization air orifice 21 and each air horn 31. The orifices 37 direct auxiliary air jets parallel to the axis 19 towards the pattern shaping air jets emitted from the orifices 32. Preferably, four additional smaller auxiliary air jet orifices 38 are formed in the air cap surface 29 with one located on opposite sides of each of the two orifices 37. Orifices 38 provide an evenly distributed sheet of auxiliary atomization air around the primary atomization air emitted from the orifice 21 to improve consistency of the patterns size and shape. The six auxiliary air orifices 37 and 38 help maximize the length of the shaped atomized paint pattern. The air streams from the auxiliary holes 37 and 38 interact with the pattern shaping air streams from the first horn orifices 32 to cause the width of the pattern shaping air streams to increase before they impact the center air around the stream of atomized fluid. The stream of atomized fluid is then deflected into an elliptical shape before it is hit by the air stream from the second horn orifices 33. This maximizes the pattern length with less tendency to split the pattern when spraying, for example, automotive refinish materials.

It has been found that for optimum suction feed when using high volume low pressure atomization air, laminar flow must be maintained in the atomization air surrounding the aspiration zone 30. Further, it has been found that when the jets of pattern shaping air emitted from the orifices 32 and 33 are too close to the orifice 16, turbulence is induced in the atomization air in the critical region surrounding the aspiration zone 30. The induced turbulence significantly limits the suction and hence limits the fluid flow rate through the orifice 16. As illustrated in FIG. 1, the pattern shaping air orifices 32 have a spacing X from the fluid discharge orifice 16 and the pattern shaping air orifices 33 have a spacing Y from the fluid discharge orifice 16. In a typical air cap used for a pressure feed HVLP paint spray gun, the distance X is 0.268 inch (0.681 cm) and the distance Y is 0.399 inch (1.013 cm). The faces 36 of the air horns were directed at an angle of 30° to the axis 19. By adjusting the atomization air orifice 21 to 0.208 inch (0.528 cm) and increasing the fluid orifice 16 to 0.086 inch (0.218 cm) a fluid flow rate of 200 grams/minute was achieved. The shaping air orifices 32 had a 0.0595 inch (0.151 cm) diameter and the shaping air orifices 33 had a 0.120 inch (0.305 cm) diameter.

In a second air cap, the air horns 31 were made longer and the distance X was increased to 0.358 inch (0.909 cm) and the distance Y was increased to 0.501 inch (1.273 cm). With the increased spacing, the shaping air orifices 32 could be increased to 0.070 inch (0.178 cm) diameter and the shaping air orifices 33 could be increased to 0.136 inch (0.345 cm) diameter. When the second air cap was also operated with a fluid tip having a 0.086 inch (0.218 cm) fluid orifice 16, the paint flow increased up to 240 grams/minute because of the increased suction. Both of the first and second air caps included the two auxiliary air orifices 37 having a diameter of 0.040 inch (0.102 cm). However, neither of the first or second air caps 12 included the four auxiliary air orifices 38. As a consequence of the longer air horns 31, the air horns 31 became dirty with paint during spraying.

A third air cap 12 was produced of similar design to the second air cap, except that four auxiliary air orifices 38 having a diameter of 0.025 inch (0.0635 cm) were added. Further, the fluid orifice 16 was enlarged to 0.110 inch (0.279 cm). With the addition of the four auxiliary air orifices 38 and the enlarged fluid orifice, the fluid flow rate increased to 300 grams/minute. The increased fluid flow was achieved through both moving the pattern shaping orifices 32 at least 0.090 inch (0.227 cm) further from the fluid orifice 16 to create a minimum spacing from the center of the pattern shaping air orifices 32 to the fluid orifice 16 of 0.35 inch (0.89 cm) and through the addition of the four auxiliary air orifices 38. The resulting increased suction in the aspiration zone 30 allowed a larger diameter fluid discharge orifice 16 to further increase fluid flow. The reduced turbulence in the atomization air surrounding the aspiration zone 30 also allows the spray gun to operate with a smaller atomization air orifice. The reduced atomization air flow allows more effective use of the pattern shaping air from the horns 31 to create a longer pattern length and to help keep the air cap clean. The nozzle assembly 10 has improved both the flow rate and the pattern length over prior art suction feed nozzle assemblies for HVLP paint spray guns.

Figure 3:
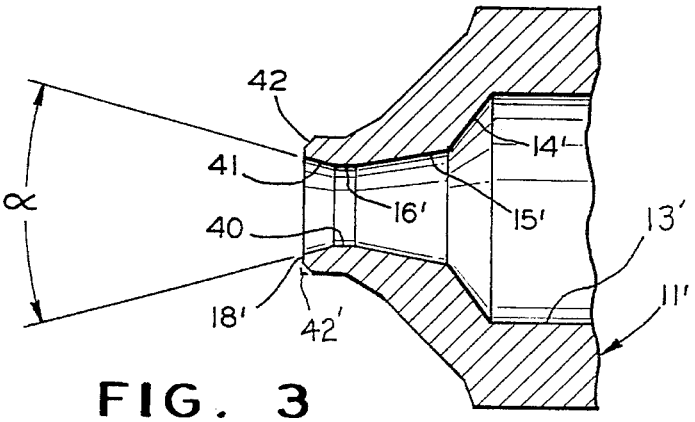
FIG. 3 is an enlarged fragmentary cross sectional view through a modified fluid tip for use is a nozzle assembly for an HVLP paint spray gun.

FIG. 3 shows a modified fluid tip 11' for use with the air cap 12 of FIGS. 1 and 2 to provide an increased uniformity of particle distribution in the atomized paint and an increased paint flow rate. The fluid tip 11' has a fluid chamber 13' having a front end 14' and a conical seat 15' identical to the fluid tip 11'. A fluid discharge orifice 16' has a straight cylindrical section 40 connecting between the seat 15' and an outwardly flaring conical section 41 which opens at the annular front face 18'. It has been found that the size of the flat annular face 18' affects the uniformity of the particle distribution in the atomized paint. An increase in the size can adversely affect the uniformity in an unpredictable manner. By flaring the orifice 16' in the section 41, the size of the face 18' is reduced and the particle distribution uniformity is improved. However, it is necessary to have a straight cylindrical section 40 in the orifice 16' upstream from the flared section 41 to improve laminar fluid flow and minimize turbulence. Preferably, the section 41 is flared at an included angle $\alpha$ of from 28° to 45°. The size of the face 18' may be further reduced by providing a chamfer 42 between the outer surface of the tubular projection 17' and the front face 18' to reduce the risk of damage. In addition to use in a suction feed HVLP spray gun, the provision of the conical or flared section 41 to the fluid discharge orifice 16' will improve particle distribution uniformity in pressure feed and gravity feed HVLP spray guns. However, the improvement is believed to be greater in a suction feed gun.

Paint flow rate for suction feed HVLP spray guns can be improved by eliminating the chamber 42, thus providing a sharp comer 42' (shown in dashed line in FIG. 3) on the outside edge of the annular face 18'. The sharp corner provides a 16% fluid flow increase at 9.5 psig (0.668 $Kg/cm^2$) center pressure over the flow rate achieved by normally chamfering this edge. This improvement in flow rate further increases at lower pressures to 110% at 3.0 psig (0.211 $Kg/cm^2$) center pressure. Such improvements allow the suction feed HVLP spray gun to operate at even lower air cap pressures thus further reducing overspray and improving transfer efficiency.

It will be appreciated that various modifications and changes may be made to the above described preferred embodiment of nozzle assembly for a suction feed HVLP spray gun without departing from the spirit and the scope of the following claims.

We claim:

1. In a nozzle assembly for a suction feed HVLP spray gun including a fluid tip and an air cap, said fluid tip having an axial orifice located on a tubular projection, said orifice opening at an annular face for discharging fluid to be atomized, said air cap having a front face defining an atomization air orifice and having a pair of air horns spaced on diametrically opposite sides of said atomization air orifice, said air horns each having at least one pattern shaping air orifice for directing a jet of pattern shaping air at and flattening an envelope of atomized fluid discharged from said fluid tip orifice, the improvement comprising positioning said tubular projection to extend through said atomization air orifice and to project from 0.000 inch to 0.020 inch from said air cap front face, and spacing the center of said pattern shaping air orifices on said air horns at least 0.35 inch from said fluid tip orifice with such spacing between said fluid tip orifice and an impingement of the pattern shaping air on the envelope of atomized fluid being sufficiently great that pattern shaping air does not create sufficient turbulence in the atomization air adjacent said fluid tip orifice to substantially reduce the suction feed fluid flow rate.

2. An improved nozzle assembly for a suction feed HVLP spray gun, as set forth in claim 1, and further including two auxiliary air orifices in said air cap face with each auxiliary air orifice located between said atomization air orifice and each air horn, said auxiliary air orifices directing air at pattern shaping air jets emitted from said air horns to flatten said pattern shaping air jets before they shape the atomized fluid pattern.

3. An improved nozzle assembly for a suction feed HVLP spray gun, as set forth in claim 1, and wherein said fluid discharge orifice has an outwardly opening conical section adjacent said annular face and has a straight cylindrical section inwardly from said conical section.

4. An improved nozzle assembly for a suction feed HVLP spray gun, as set forth in claim 3, wherein said conical section of said fluid tip orifice has an included angle of from 28° to 45°.

5. In a nozzle assembly for a suction feed HVLP spray gun including a fluid tip and an air cap, said fluid tip having an axial orifice located on a tubular projection, said orifice opening at an annular face for discharging fluid to be atomized, said air cap having a front face defining an atomization air orifice and having a pair of air horns spaced on diametrically opposite sides of said atomization air orifice, said air horns each having at least one pattern shaping air orifice for directing a jet of pattern shaping air at and flattening an envelope of atomized fluid discharged from said fluid tip orifice, the improvement comprising positioning said tubular projection to extend through said atomization air orifice with said annular face at or in front of said air cap front face, and wherein said pattern shaping air orifices are spaced on said air horns a sufficient distance from said fluid discharge orifice to prevent pattern shaping air from inducing turbulence in atomization air adjacent said fluid discharge orifice.

6. In a nozzle assembly for a suction feed HVLP spray gun including a fluid tip and an air cap, said fluid tip having an axial orifice located on a tubular projection which extends through an atomization air opening in said air cap, said orifice opening at a flat annular face on said tubular projection for discharging fluid to be atomized, the improvement comprising shaping said fluid discharge orifice to have an outwardly opening conical section adjacent said annular face and to have a straight cylindrical section inwardly from said conical section.

7. A nozzle assembly for an HVLP spray gun, as set forth in claim 6, and wherein said conical section of said fluid tip orifice has an included angle of from 28° to 45°.

8. A nozzle assembly for an HVLP spray gun, as set forth in claim 6, wherein said tubular section has a cylindrical outer surface, and a sharp corner formed between said cylindrical outer surface and said flat annular face.

9. In a nozzle assembly for a suction feed HVLP spray gun including a fluid tip and an air cap, said fluid tip having an axial orifice located on a tubular projection, said orifice opening at an annular face for discharging fluid to be atomized, said air cap having a front face defining an atomization air orifice and having a pair of air horns spaced on diametrically opposite sides of said atomization air orifice, said air horns each having at least one pattern shaping air orifice for directing a jet of pattern shaping air at and flattening an envelope of atomized fluid discharged from said fluid tip orifice, the improvement comprising positioning said tubular projection to extend through said atomization air orifice and to project from 0.000 inch to 0.020 inch from said air cap front face, spacing the center of said pattern shaping air orifices on said air horns at least 0.35 inch from said fluid tip orifice, two auxiliary air orifices in said air cap face with one of said auxiliary air orifices located between said atomization air orifice and each air horn, said auxiliary air orifices directing air at pattern shaping air jets emitted from said air horns to flatten said pattern shaping air jets before they shape the atomized fluid pattern, and four additional auxiliary air orifices in said air cap face, two of said additional auxiliary air orifices located on diametrically opposite sides of each of said two auxiliary air orifices, said additional auxiliary air orifices directing jets of air parallel to the axis of said fluid tip orifice.

10. An improved nozzle assembly for a suction feed HVLP spray gun, as set forth in claim 9, and wherein each of said additional auxiliary air orifices is smaller than an adjacent auxiliary air orifice.

11. In a nozzle assembly for a suction feed HVLP spray gun including a fluid tip and an air cap, said fluid tip having a fluid discharge orifice, said air cap having a front face defining an annular atomization air orifice surrounding said fluid discharge orifice whereby atomization air flow creates suction to draw fluid through said fluid discharge orifice, said air cap further having a pair of air horns spaced on diametrically opposite sides of said atomization air orifice, said air horns each having at least one pattern shaping air orifice for directing a jet of pattern shaping air at and flattening an envelope of atomized fluid discharged from said fluid discharge orifice, the improvement comprising arranging said pattern shaping air orifices to impinge pattern shaping air against such atomized fluid envelope a sufficient distance from said fluid discharge orifice that such pattern shaping air does not create sufficient turbulence in the atomization air adjacent said fluid discharge orifice to substantially reduce the suction feed fluid flow rate.

* * * * *